US011091914B2

(12) United States Patent
Shan et al.

(10) Patent No.: US 11,091,914 B2
(45) Date of Patent: Aug. 17, 2021

(54) LOUVER CANOPY

(71) Applicants: Caihua Shan, Taizhou (CN); Gaoyang Xu, Taizhou (CN); Yucheng Shan, Taizhou (CN); Chao Han, Taizhou (CN); Jie Ding, Taizhou (CN); Ruzhong Yin, Taizhou (CN); Rixin Liang, Taizhou (CN); Zheng Zhou, Taizhou (CN); Yongna Han, Taizhou (CN); Ji Zhou, Taizhou (CN); Kaiyu Ni, Taizhou (CN)

(72) Inventors: Caihua Shan, Taizhou (CN); Gaoyang Xu, Taizhou (CN); Yucheng Shan, Taizhou (CN); Chao Han, Taizhou (CN); Jie Ding, Taizhou (CN); Ruzhong Yin, Taizhou (CN); Rixin Liang, Taizhou (CN); Zheng Zhou, Taizhou (CN); Yongna Han, Taizhou (CN); Ji Zhou, Taizhou (CN); Kaiyu Ni, Taizhou (CN)

(73) Assignee: Zhejiang Dosoly Mechanical and Electrical Technology Co., Ltd., Taizhou (CN)

( * ) Notice: Subject to any disclaimer, the term of this patent is extended or adjusted under 35 U.S.C. 154(b) by 0 days.

(21) Appl. No.: 16/878,649

(22) Filed: May 20, 2020

(65) Prior Publication Data

US 2020/0370299 A1 Nov. 26, 2020

(51) Int. Cl.
*E04B 7/00* (2006.01)
*E04D 13/035* (2006.01)
(Continued)

(52) U.S. Cl.
CPC ..... *E04D 13/0354* (2013.01); *E04D 13/0445* (2013.01); *E04D 13/064* (2013.01); *E04F 10/08* (2013.01); *E04D 2013/045* (2013.01)

(58) Field of Classification Search
None
See application file for complete search history.

(56) References Cited

U.S. PATENT DOCUMENTS 1,408,432 A * 3/1922 Arnold ..... F24F 7/02 52/64
2,210,869 A * 8/1940 Larson ..... F24F 13/15 49/91.1
(Continued)

FOREIGN PATENT DOCUMENTS

CN 103899227 B 6/2016
CN 207277716 U 4/2018
(Continued)

*Primary Examiner* — Basil S Katcheves
(74) *Attorney, Agent, or Firm* — Minder Law Group; Willy H. Wong

(57) ABSTRACT

A louver canopy comprises a frame with a top disposed with parallel rafters; a plurality of louvers rotationally connected between the rafters and sequentially arranged along a length direction of the rafters, the louvers are disposed at intervals and parallel to each other, each of the louvers includes an elongated flashing; a baffle connected to a first long side of the flashing; an elongated first guide groove formed between the baffle and the flashing; When the louvers rotate to a closed state, an opening of the first guide groove faces upward, and a second long side of the flashing passes over a top of the baffle of an adjacent louver of the louvers and positions above the first guide groove of the adjacent louver.

8 Claims, 11 Drawing Sheets

(51) Int. Cl.

| | |
|---|---|
| ***E04D 13/04*** | (2006.01) |
| ***E04D 13/064*** | (2006.01) |
| ***E04F 10/08*** | (2006.01) |

(56) References Cited

U.S. PATENT DOCUMENTS

| | | | | | |
|---|---|---|---|---|---|
| 2,654,425 | A * | 10/1953 | De Eldon | E04F 10/10 | 160/62 |
| 4,527,355 | A * | 7/1985 | Numakami | E04F 10/10 | 49/275 |
| 4,926,599 | A * | 5/1990 | Scholz | E04F 10/10 | 49/87.1 |
| 5,306,210 | A * | 4/1994 | Smit | F24F 7/02 | 454/250 |
| 8,413,389 | B2 * | 4/2013 | Frigerio | E04F 10/10 | 52/75 |
| 8,413,705 | B2 * | 4/2013 | Castel | E06B 9/386 | 160/107 |
| 9,650,786 | B2 * | 5/2017 | Weaver | E04B 7/163 | |
| 2004/0148899 | A1 * | 8/2004 | Pertile | E06B 7/086 | 52/581 |
| 2006/0040607 | A1 * | 2/2006 | Perez | E06B 7/086 | 454/358 |

FOREIGN PATENT DOCUMENTS

| | | | |
|---|---|---|---|
| CN | 208065118 | U | 11/2018 |
| CN | 208473145 | U | 2/2019 |
| CN | 208587082 | U | 3/2019 |

* cited by examiner

LOUVER CANOPY

RELATED APPLICATIONS

This application claims priority to Chinese Patent Application No. CN201910423880.6, filed May 21, 2019.

The above applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of canopy and relates to a louver canopy.

Related Art

Canopy is a type of assembly that is installed above the entrance or the top balcony of a building to block rain and wind, and prevent injury caused by objects falling from high altitude. The existing canopy is generally fixed, and the movable canopy is generally composed of a plurality of flashings or a soft tarpaulin cover. When the flashings need to be opened, they need to be removed manually one by one, or the tarpaulin cover needs to be manually rolled up and folded when it needs to be opened. It is very troublesome, and when it rains suddenly, it is often too late to put back to position to shelter from the rain.

In order to solve this problem, the existing canopy adopts a louver structure. By rotating the louvers to realize rapid switching between opening and closing states of the canopy, and opening and closing degrees of the louvers can be adjusted according to the sunlight irradiation condition when the weather is sunny to realize light adjustment and promote air circulation inside the canopy. When the canopy is closed, the adjacent louvers are tightly fitted with each other through the sealing rings that are sleeved on the louvers to prevent rainwater from flowing into the canopy. However, after the canopy is opened and closed multiple times, wear between the sealing rings is relatively greater, and the sealing rings are prone to deterioration phenomenon after long-term use, which easily cause the sealing rings to be incapable of tightly fitting with each other, resulting in the problem of water leakage of the canopy on rainy days.

For example, Chinese utility model patent with publication patent number CN208473145U discloses a louver roof and a louver canopy including a frame, a driving portion and a plurality of louvers; the frame has an accommodating space, and the louvers are disposed in parallel to each other in the accommodating space; the driving portion includes a driving rod perpendicular to the louvers, each of the louvers has a driving side, a middle part of the driving side is rotationally connected with the frame, ends of the driving side are rotationally connected with the driving rod; and one end of the driving rod is disposed with a driving member for driving the driving rod to displace axially. Sealing strips are adhered on the louvers of the louver canopy, which are also prone to wear or deterioration after multiple times of opening and closing or long-term use, resulting in water leakage of the canopy. Furthermore, the process of raining is often accompanied by strong winds, when objects entrained in the wind fall on the canopy, they will accumulate and are difficult to clean up, and even affect normal opening and closing of the louvers in the later period. In order to solve the problem with cleaning canopy, technicians skilled in the art may generally consider adding flushing or blowing devices to clean the objects accumulated on the canopy top surface, or setting a lifting device to lower the canopy after the rain stops to facilitate manual cleaning, but the above solutions will increase the manufacturing costs and structural complexity.

SUMMARY OF THE INVENTION

The present invention provides a louver canopy in view of the above problems existing in the prior art. The technical problem to be solved by the present invention is: how to prevent the canopy from leaking water and accumulation of objects that have fallen on the canopy when it rains.

The objects of one embodiment of the louver canopy can be achieved by the following technical solutions:

One embodiment of the louver canopy comprises a frame with a top having parallel rafters; a plurality of louvers, each of the louvers has an elongated flashing, the flashing has a first long side and a second long side; a baffle is disposed at the first long side of the flashing to form an elongated first guide groove, the first guide groove has two outlets respectively disposed at two ends of the first guide groove. The louvers are rotationally connected between the rafters and sequentially arranged along a length direction of the rafters, the louvers are disposed at intervals and are parallel to each other, When the louvers rotate to a closed state, an opening of the first guide groove faces upward, and the second long side of the flashing passes over a top of the baffle of an adjacent louver of the louvers and positions above the first guide groove of the adjacent louver.

One embodiment of the frame is used for support and the top thereof is installed with the louvers, the louvers are disposed parallelly at intervals between the rafters of the top of the frame, the rafters can be disposed horizontally or obliquely, and two ends of each of the louvers are equipped with operating devices. Through operation of a user adjustment of a deflection angle of each of the louvers can be realized, the louvers are basically vertical when being opened by rotating, and large spaces are provided between the adjacent louvers to allow light to illuminate through to enhance a brightness inside the canopy. When the louvers are rotated to be closed, the openings of the first guide grooves face upward, rainwater or rainwater with objects drips directly into the first guide grooves or onto the flashings and flows into the first guide grooves along the flashings, and then drains through the two outlets at the two ends of each of the first guide grooves. And when the louvers are rotated to be closed, the second long side of the flashing passes over the top of the baffle of an adjacent louver of the louvers and positions above the first guide groove of the adjacent louver, so that the two adjacent louvers overlap each other to avoid rainwater from falling into the canopy from between the two louvers. At the same time, the second long side is capable of draining the rainwater or rainwater with objects dripped on it to the first guide groove below the second long side to facilitate fast discharge of rainwater or objects. Compared with the prior art which uses the sealing ring or sealing strip for tight fit to achieve vertical closure between the adjacent louvers, the present invention disposes the first guide grooves on the louvers to drain rainwater or objects by channelizing to avoid the problems of easy wearing and deterioration of the sealing ring or sealing strip to ensure that the canopy does not leak water and avoid accumulation of objects on the canopy. And The rafters are disposed obliquely, such that the top of the canopy is tilted to facilitate rainwater or rainwater with objects to slide downward along the louvers, so that it is easy for the fallen objects to slide downward and not easy to accumulate. Furthermore, the fallen objects are generally light and thin and can be easily attached on surfaces of the wet louvers and are difficult to clean. During the process of raining, rainwater will first gather in the first guide grooves, when the first guide grooves are full, the rainwater continues to flow downward. When the rainfall is large, a water flow rate at the top of the canopy is large and can drive the fallen objects to flow downward along with the rainwater. When the rainfall is small, the fallen objects can partially float on a surface of liquid in the first guide grooves, in order to prevent the objects from fully adhering on the louvers due to a thin water film between the objects and the louvers, and the objects can still flow downward along with the water current under continuous impact of the rainwater from above, so as to avoid accumulation of objects adhering on the surfaces of the louvers when the rainfall is small. With the groove wall of the first guide groove located at the side of the baffle being higher than the flashing, especially for structural disposition of the second long side of the flashing passing over the top of the baffle of an adjacent louver of the louvers and positioning above the first guide groove of the adjacent louver below when the louvers are in the closed state, it can ensure that after the first guide groove is full, the water current can flow downward toward the adjacent first guide groove, which impacts the objects and causes the objects to leave the top of the canopy under the actions of component force of gravity and water flow impulse, thereby avoiding accumulation of the objects, and preventing the water current from flowing into the canopy from the baffle after the first guide groove is full to ensure that the canopy does not leak water.

In one embodiment of the above-mentioned louver canopy, the flashing has an extended section extending toward the first guide groove of the adjacent louver, and the flashing smoothly transitions from the first long side to the second long side. The second long side is located at an end of the extended section, and when the louvers rotate to the closed state, the extended section is in a downwardly inclined state. With the flashing smoothly transitioning from the first long side to the second long side, resistance of rainwater or rainwater with objects being subjected to during the flow can be reduced, making movement of the rainwater or rainwater with objects more smooth to avoid accumulation of objects. By disposing the extended section, the water current and objects flow faster due to the action of component force of gravity, further reducing the time of movement of objects in areas other than the first guide grooves, and preventing objects from adhering on the louvers.

In one embodiment of the above-mentioned louver canopy, when the louvers rotate to the closed state, an activity space is formed between the second long side of the flashing and the baffle of the adjacent louver, and continued rotation of the louvers is capable of causing the baffle and the adjacent louver to abut each other. By forming the activity space between the second long side of the flashing and the baffle of the adjacent louver when the louvers rotate to the closed state, the canopy has better ventilation effect while achieving sheltering from rain, and when it rains, mist or odor generated inside the canopy can diffuse quickly. In addition, after the rain stops, the user can operate the louvers to continue to rotate and compress the activity space to reach an abutment state to ensure that the rainwater will not fall into the canopy. And the first guide grooves will be tilted due to rotation, the rainwater stored in the first guide grooves will overflow and flow downward, so that a small amount of objects left on the top of the canopy after the rain has stopped can successfully leave the canopy by the impact of this part of the rainwater to achieve an active cleaning effect, and further avoid accumulation of objects.

In one embodiment of the above-mentioned louver canopy, the second long side of the flashing is bent and extended to form a flashing flange, and when the louvers rotate to the closed state, the flashing flange is inserted into the first guide groove of the adjacent louver. That is, in the closed state, a bottom of the flashing flange is lower than the top of the baffle of the adjacent louver, such that even when a greater external wind force drives water droplets to fall laterally, it is difficult to enter into the canopy through the spaces between the louvers.

In one embodiment of the above-mentioned louver canopy, a baffle flange bending toward the flashing is provided at an edge of the baffle away from the flashing. A drainage groove is formed by the baffle flange and the baffle, and the baffle also serves as part of a groove wall of the drainage groove and part of a groove wall of the first guide groove, so that water in the drainage groove can be discharged through the two outlets at the two ends of each of the first guide grooves. When the user rotates to open the louvers to almost reach the vertical state, part of the rainwater trapped in the first guide groove will flow into the drainage groove along the baffle and be constrained by the baffle flange, and eventually flow toward two ends of the drainage groove and flow out through the outlets, and will not spill inside the canopy when opening the louvers.

In one embodiment of the above-mentioned louver canopy, a width dimension of the opening of the first guide groove is greater than ¼ of a width dimension of the flashing. By setting the width dimension of the opening of the first guide groove to be greater than ¼ of the width dimension of the flashing, this ensures that the fallen objects have sufficient areas contacting with the rainwater in the first guide grooves, which reduces a probability of the objects adhering to the surfaces of the louvers to further avoid accumulation of objects.

In one embodiment of the above-mentioned louver canopy, the top of the frame further has a transverse beam, and the louvers are arranged on two sides of the transverse beam respectively. In this way, a slope of the top of the canopy can be greater under a same height condition, which increases the difficulty of accumulation of objects and is beneficial to space utilization.

In one embodiment of the above-mentioned louver canopy, each of the rafters has a second guide groove disposed along a length direction of each of the rafters, the second guide groove is located directly below junctions of the louvers and the corresponding rafter, the transverse beam has gutters disposing along a length direction of the transverse beam, the gutters are located directly below a junction of the louver and the transverse beam. Two ends of each of the gutters communicate with the adjacent second guide grooves respectively, in this way, part of the rainwater flowing down from the junctions of the louvers and the transverse beam can be collected into the gutters and discharged through the second guide grooves to prevent the rainwater from affecting the canopy internally.

In one embodiment of the above-mentioned louver canopy, the frame further includes a plurality of columns supporting the rafters, inside each of the columns has a downspout penetrating from top to bottom, an upper end of the downspout communicates with the second guide groove. In this way, rainwater or rainwater with objects flowing into the second guide grooves can flow down the downspout.

In one embodiment of the above-mentioned louver canopy, a bottom of each of the columns is provided with outfalls facing toward an outer side of the canopy, and the outfalls communicate with a lower end of the downspout. Rainwater or rainwater with objects flowing into the first guide grooves flows from the outlets to the second guide grooves and the downspouts and is discharged to the outside of the canopy through the outfalls sequentially to prevent the rainwater from affecting the canopy internally.

Compared with the prior art, the advantages of one embodiment of the louver canopy are as follows:

1. The top of the louver canopy is tilted by disposing the obliquely downwardly extending rafters at the top of the frame and arranging the louvers along the length direction of the rafters, so that it is easy for the fallen objects to slide downward due to the action of gravity and not easy to accumulate. By disposing the louvers including the flashings and the baffles and forming the first guide groove between each of the flashings and each of the baffles; during the process of raining, rainwater will first gather in the first guide grooves, when the first guide grooves are full, the rainwater continues to flow downward. When the rainfall is large, a water flow rate at the top of the canopy is large and can drive the fallen objects to flow downward along with the rainwater. When the rainfall is small, the fallen objects can partially float on a surface of liquid in the first guide grooves, in order to prevent the objects from fully adhering on the louvers due to a thin water film between the objects and the louvers, and the objects can still flow downward along with the water flow under continuous impact of the rainwater from above, so as to avoid accumulation of objects adhering on the louver surfaces when the rainfall is small. With an outer side of the baffle being higher than the flashing, and another side of the flashing positioning directly above the first guide groove of the adjacent louver below, it can ensure that after the first guide groove is full, the water current can flow downward toward the adjacent first guide groove, which impacts the objects and causes the objects to leave the top of the canopy under the actions of component force of gravity and water flow impulse, thereby avoiding accumulation of the objects.

2. In the closed state of the louver canopy, by forming the activity space between the other side of the flashing and the baffle of the adjacent louver below, after the rain stops, the user can operate the louvers to continue to rotate and compress the activity space to reach an abutment state, such that the first guide grooves will be tilted due to rotation, the rainwater stored in the first guide grooves will overflow and flow downward, so that a small amount of objects left on the top of the canopy after the rain has stopped can successfully leave the canopy by the impact of this part of the rainwater to achieve an active cleaning effect, and further avoid accumulation of the objects.

DETAILED DESCRIPTION OF THE INVENTION

The technical solutions of the present invention are further described below with reference to the specific embodiments of the present invention in conjunction with the accompanied drawings, but the present invention is not limited to the embodiments.

Figure 1:
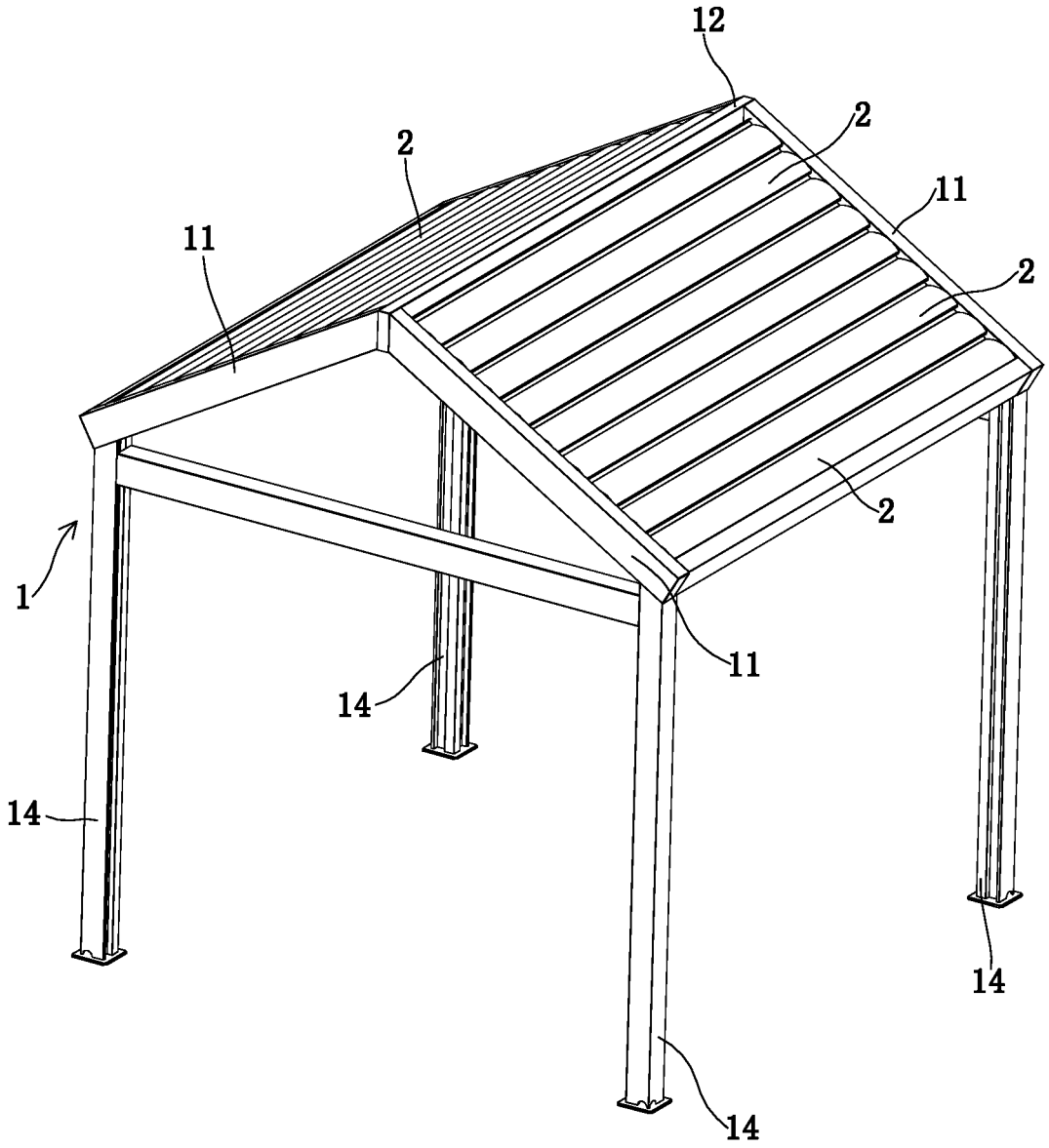
FIG. 1 is a perspective view of one embodiment of a louver canopy in a closed state.
Figure 2:
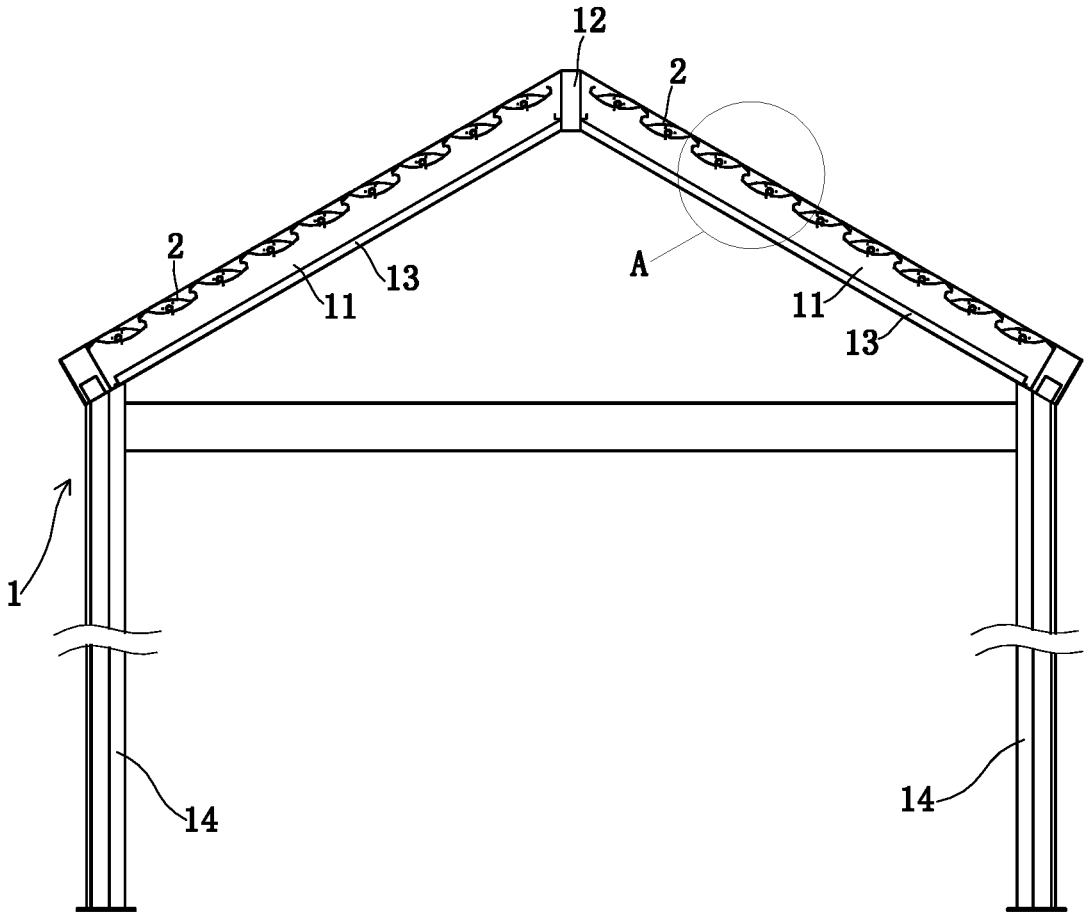
FIG. 2 is a cross-sectional view of one embodiment of the louver canopy in the closed state.
Figure 3:
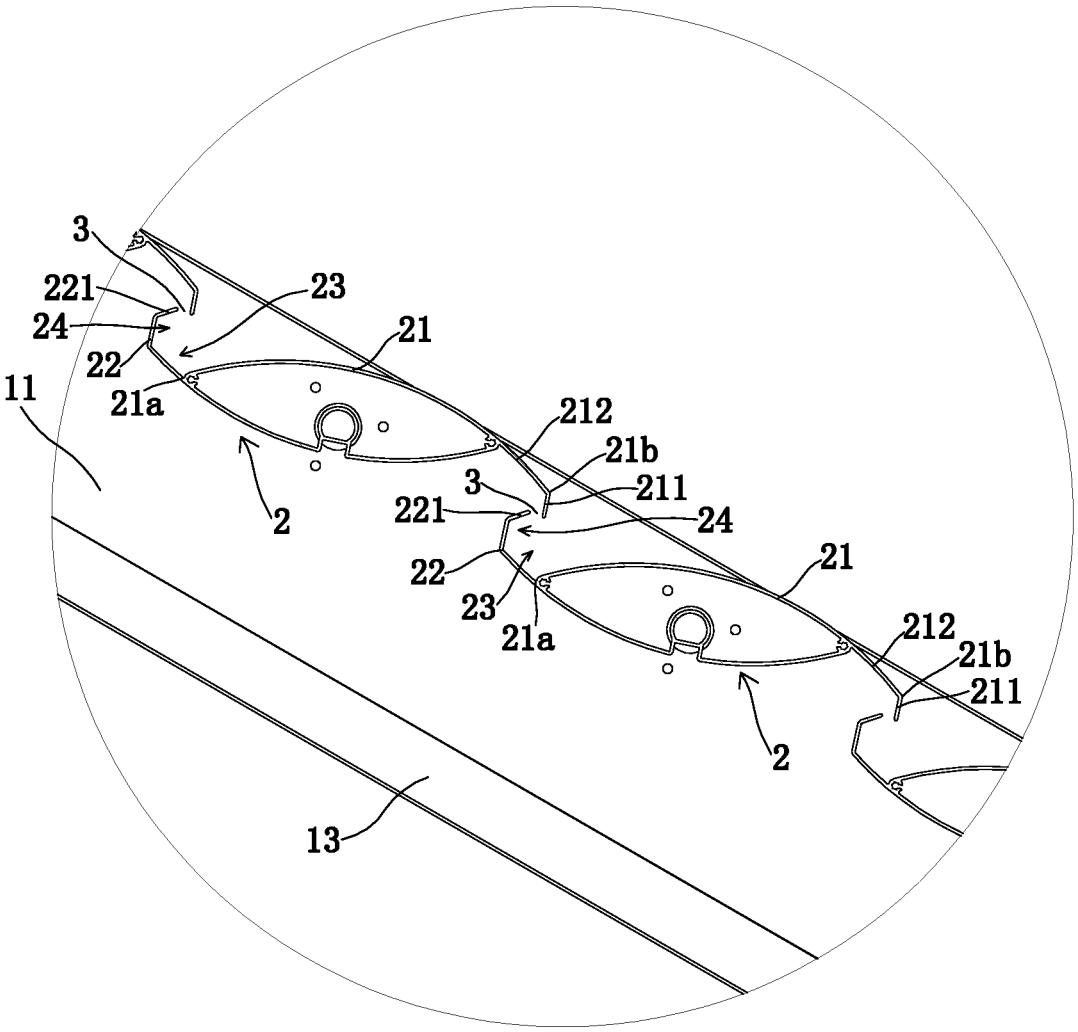
FIG. 3 is an enlarged view of part A in FIG. 2.
Figure 4A:
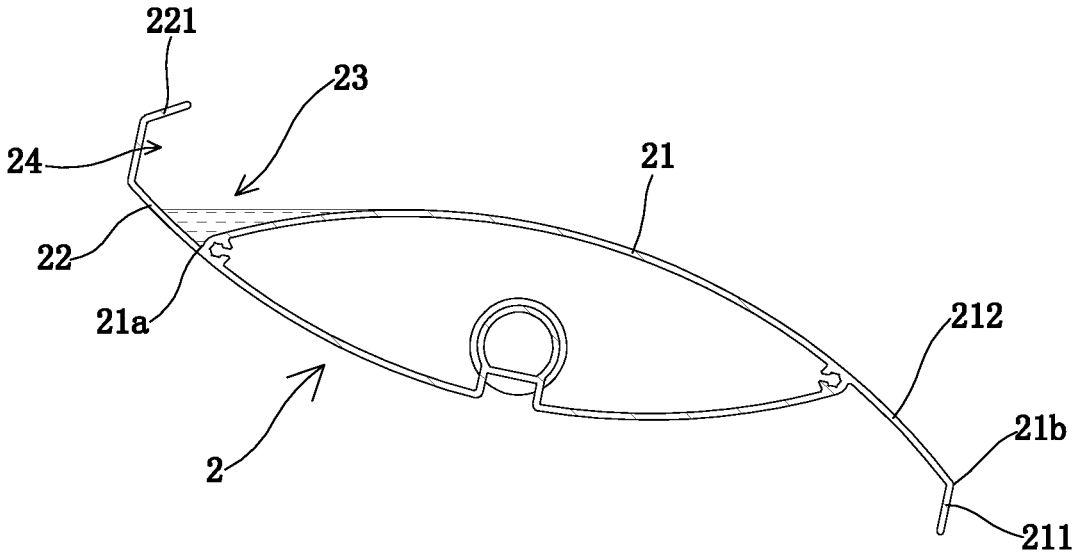
FIG. 4*a* is a cross-sectional view of one embodiment of a louver storing water when the louver canopy is in the closed state.
Figure 4B:
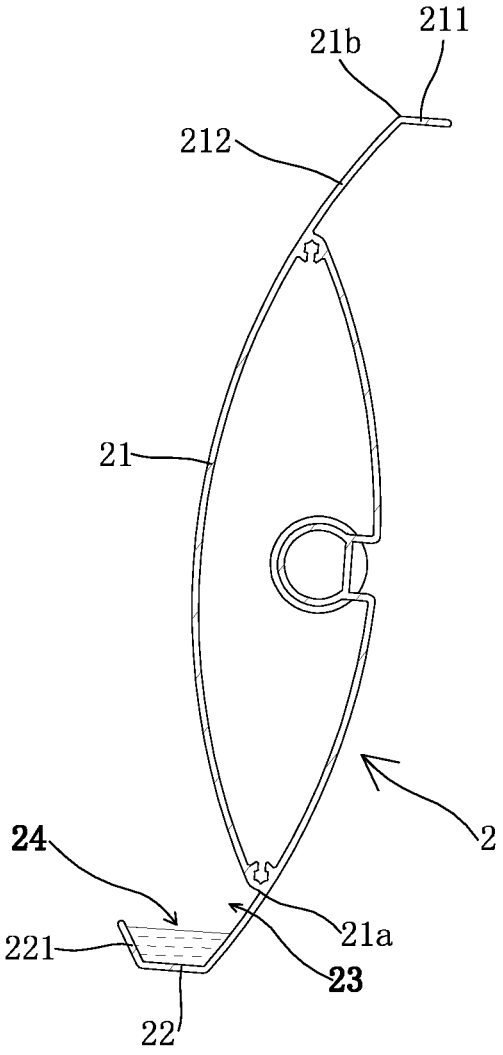
FIG. 4*b* is a cross-sectional view of one embodiment of the louver of FIG. 4*a* being rotated to a vertical direction.
Figure 5:
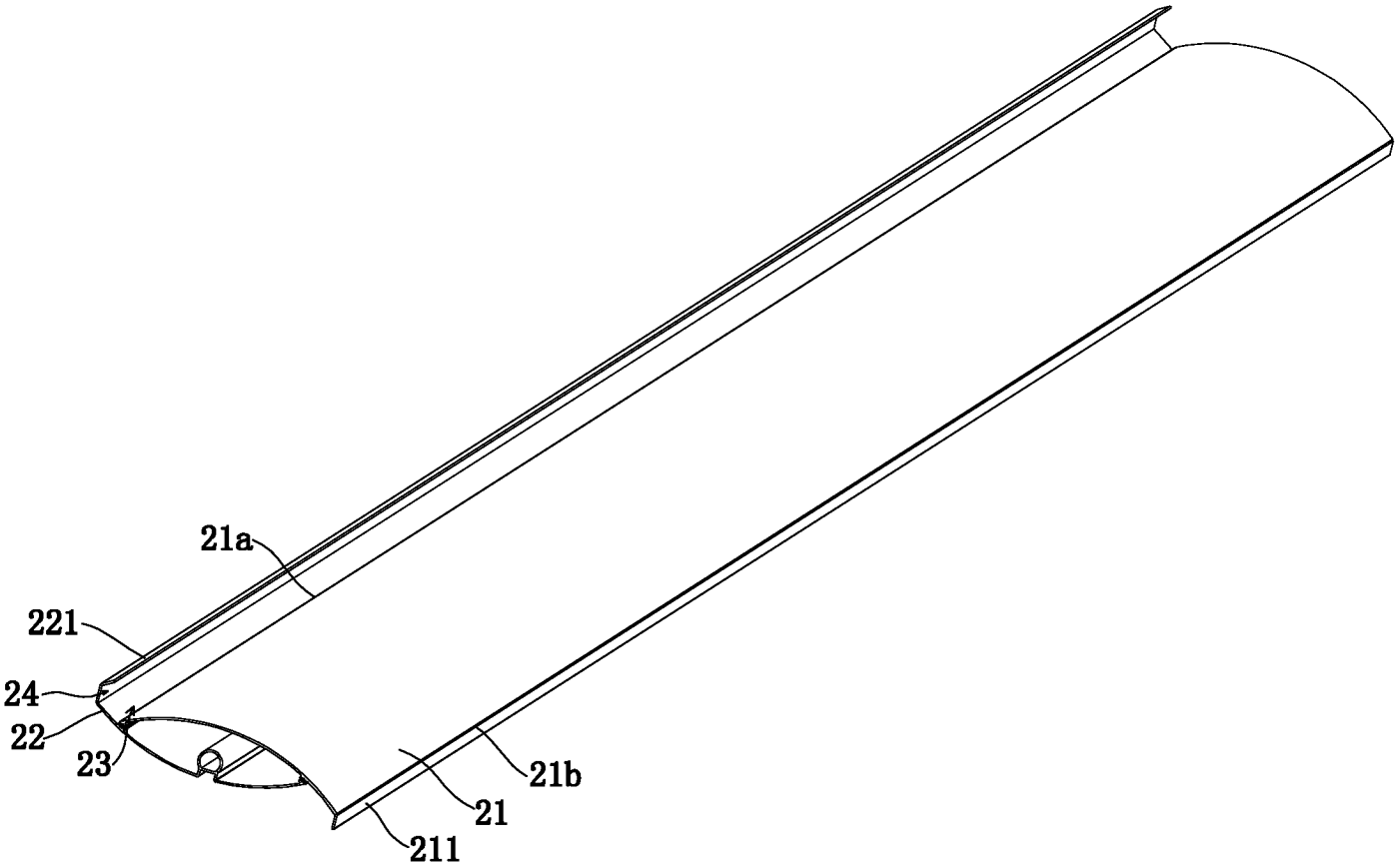
FIG. 5 is a perspective view of one embodiment of the louver.
Figure 6:
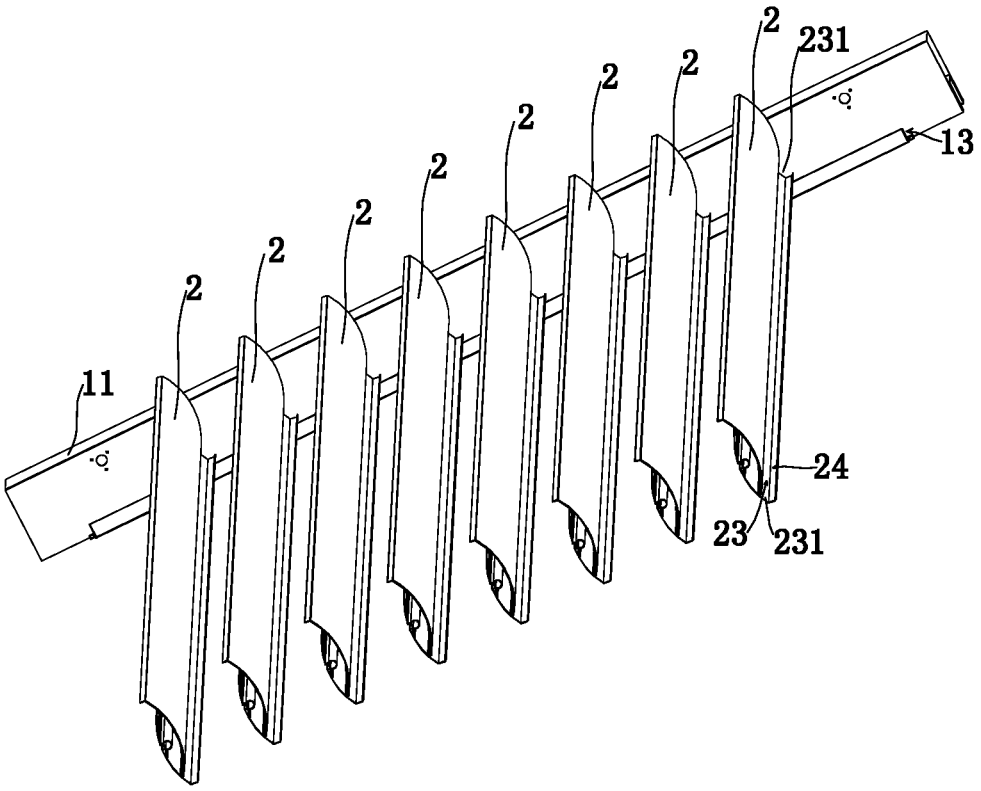
FIG. 6 is a perspective view of a partial structure of one embodiment of the louver canopy in an opened state.
Figure 7:
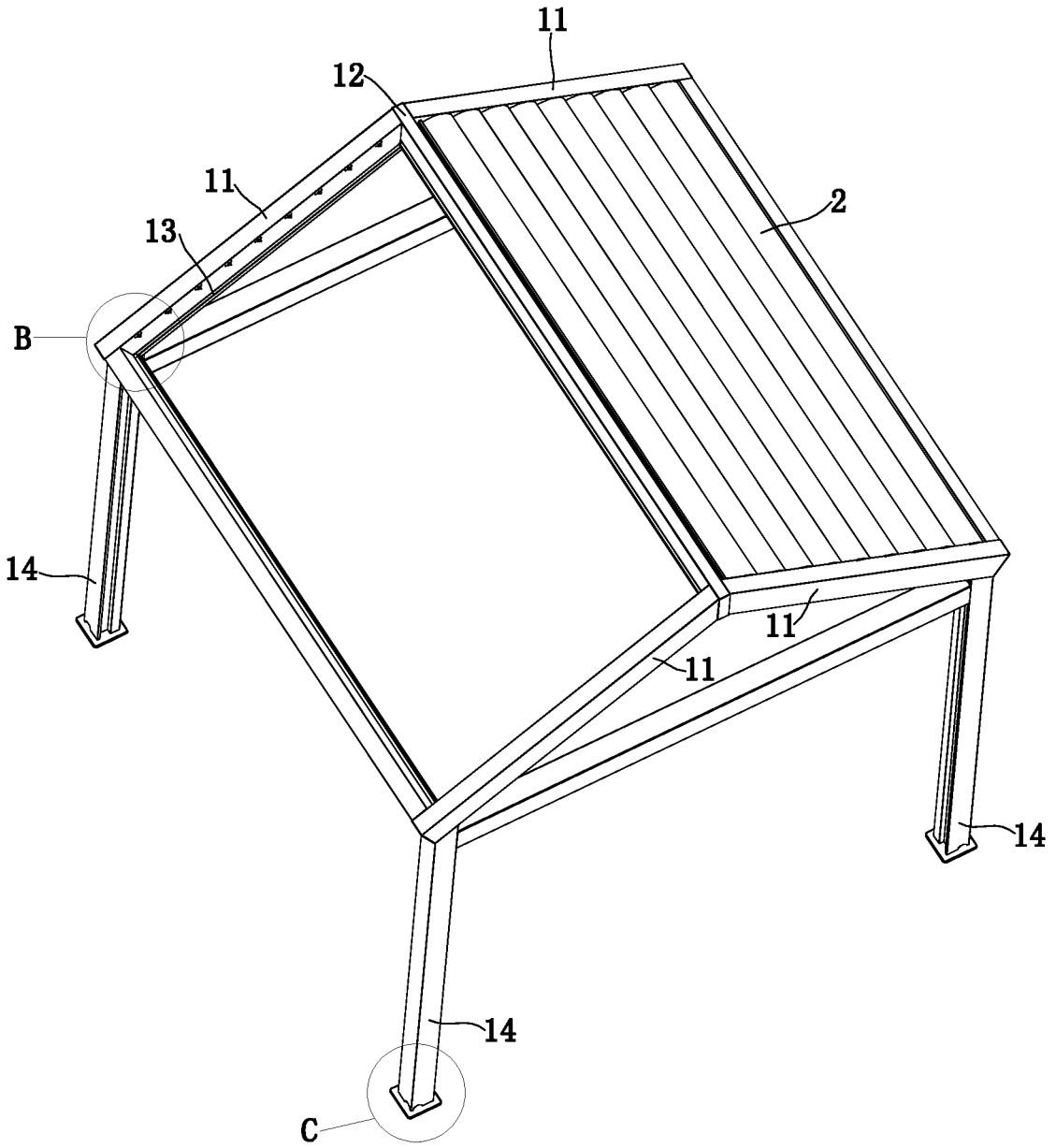
FIG. 7 is a perspective view with some louvers being omitted when one embodiment of the louver canopy is in the closed state.
Figure 8:
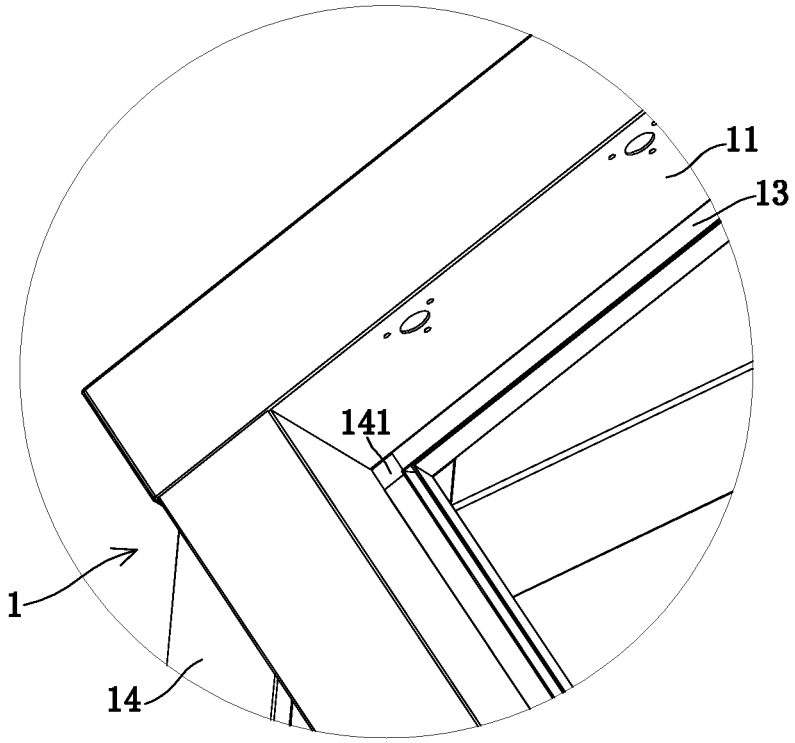
FIG. 8 is an enlarged view of part B in FIG. 7.

As shown in FIGS. 1-8, one embodiment of a louver canopy includes a frame 1 and a plurality of louvers 2 rotationally connected to a top of the frame 1, the louvers 2 are disposed at intervals and parallel to each other, and the louvers 2 are capable of rotating to close the top of the frame 1 vertically. The top of the frame 1 has four rafters 11 that extend downward obliquely from a center toward an outer side of the frame 1. The louvers 2 are disposed between two of the parallel rafters 11 and arranged along a length direction of the rafters 11 sequentially, and two ends of the louver 2 directly abut against the rafters 11 respectively. Each of the louvers 2 includes an elongated flashing 21, and the flashing 21 includes a first long side 21*a* and a second long side 21*b*. A baffle 22 is connected to the first long side 21*a* of the flashing 21, an elongated first guide groove 23 is formed between the baffle 22 and the flashing 21, and two outlets 231 are respectively disposed at two ends of the first guide groove 23. When the louvers 2 rotate to a closed state, a groove wall of the first guide groove 23 located at a side of the baffle 22 is higher than the flashing 21, an opening of the first guide groove 23 faces upward, and the second long side 21*b* of the flashing 21 passes over a top of the baffle 22 of an adjacent louver 2 of the louvers 2 and positions above the first guide groove 23 of the adjacent louver 2. The frame 1 is used for support and the top thereof is installed with the louvers 2, the louvers 2 are disposed parallelly at intervals at the top of the frame 1, and the two ends of each of the louvers 2 are equipped with operating devices. Through operation of a user adjustment of a deflection angle of each of the louvers 2 can be realized, the louvers 2 are basically vertical when being opened by rotating, and large spaces are provided between the adjacent louvers 2 to allow light to illuminate through to enhance a brightness inside the canopy. When the louvers 2 are rotated to be closed, the adjacent louvers 2 rotate correspondingly and overlap each other one by one and are completely closed in a vertical direction, so that falling rainwater cannot fall into the canopy. The top of the louver canopy is tilted by disposing the obliquely downwardly extending rafters 11 at the top of the frame 1 and arranging the louvers 2 along the length direction of the rafters 11, so that it is easy for fallen objects to slide downward and not easy to accumulate. Fallen objects, such as leaves, are generally light and thin and can be easily attached on surfaces of the wet louvers 2 and are difficult to clean. This problem can be solved by disposing the louvers 2 including the flashings 21 and the baffles 22 and forming the first guide groove 23 between each of the flashings 21 and each of the baffles 22, wherein the baffle 22 is a bent plate including a first plate connected to the flashing 21, and a second plate connected to the first plate and extending in a direction away from the flashing 21, the first plate and the second plate are connected at an obtuse angle, which is beneficial to increase a water storage capacity of the first guide groove 23. In this way, during the process of raining, rainwater will first gather in the first guide grooves 23, when the first guide grooves 23 are full, the rainwater continues to flow downward. When the rainfall is large, a water flow rate at the top of the canopy is large and can drive the fallen objects to flow downward along with the rainwater. When the rainfall is small, the fallen objects can partially float on a surface of liquid in the first guide grooves 23, in order to prevent the objects from fully adhering on the louvers 2 due to a thin water film between the objects and the louvers 2, and the objects can still flow downward along with the water flow under continuous impact of the rainwater from above, so as to avoid accumulation of the objects adhering on the surfaces of the louvers 2 when the rainfall is small. With the groove wall of the first guide groove 23 located at the side of the baffle 22 being higher than the flashing 21, and the second long side 21*b* of the flashing 21 passing over the top of the baffle 22 of the adjacent louver 2 of the louvers 2 and positioning above the first guide groove 23 of the adjacent louver 2, it can ensure that after the first guide groove 23 is full, the water current can flow downward toward the adjacent first guide groove 23, which impacts the objects and causes the objects to leave the top of the canopy under the actions of component force of gravity and water flow impulse, thereby avoiding accumulation of the objects. Further, the flashing 21 has a extended section 212 extending toward the first guide groove 23 of the adjacent louver 2, and the second long side 21*b* is located at an end of the extended section 212. When the louvers 2 rotate to the closed state, the extended section 212 is in a downwardly inclined state, the flashing 21 smoothly transitions from the first long side 21*a* to the second long side 21*b*, and specifically, an upper surface of the flashing 21 is arcuate. By disposing the extended section 212 of the flashing 21, the water current and objects flow faster due to the action of component force of gravity, thereby reducing the time of movement of the objects in areas other than the first guide grooves 23, and preventing the objects from adhering on the louvers 2. With the flashing 21 smoothly transitioning from the first long side 21*a* to the second long side 21*b*, resistance of the objects being subjected to during the flow can be further reduced, making movement of the objects more smooth to avoid accumulation of objects. Preferably, when the louvers 2 rotate to the closed state, an activity space 3 is formed between the second long side 21*b* of the flashing 21 and the baffle 22 of the adjacent louver 2 below, and continued rotation of the louvers 2 is capable of causing the adjacent louvers 2 to abut each other. By forming the activity space 3 between the second long side 21*b* of the flashing 21 and the baffle 22 of the adjacent louver 2 below when the louvers 2 rotate to the closed state, the canopy has better ventilation effect while achieving sheltering from rain, and when it rains, mist or odor generated inside the canopy can diffuse quickly. In addition, after the rain stops, the user can operate the louvers 2 to continue to rotate and compress the activity space 3 to reach an abutment state, and the first guide groove 23 will be tilted due to rotation, the rainwater stored in the first guide groove 23 will overflow and flow downward, so that a small amount of objects left on the top of the canopy after the rain has stopped can successfully leave the canopy by the impact of this part of the rainwater to achieve an active cleaning effect, and further avoid accumulation of objects. The second long side 21*b* of the flashing 21 is bent and extended to form a flashing flange 211, and when the louvers 2 are rotated to the closed state, the flashing flange 211 is inserted into the first guide groove 23 of the adjacent louver 2. That is, when the louvers 2 are rotated to the closed state, a position of a bottom end of the flashing flange 211 is lower than a position of the top of the baffle 22 of the adjacent louver 2 below. By disposing the flashing flange 211 extending downward relative to the flashing 21 at the second long side 21*b* of the flashing 21, in the closed state, the flashing flange 211 is positioned directly above the first guide groove 23 of the adjacent louver 2 below, and the position of the bottom end of the flashing flange 211 is lower than the position of the top of the baffle 22 of the adjacent louver 2 below, such that even when a greater external wind force drives water droplets to fall laterally, it is difficult to enter into the canopy through the spaces between the louvers 2. A baffle flange 221 bending toward the flashing 21 is provided at an outer side of the baffle 22, and a drainage groove 24 for water storage is formed between the baffle flange 221 and the baffle 22; that is, the drainage groove 24 is formed between the first plate and the second plate and the baffle flange 221 of the baffle 22. The baffle 22 also serves as part of a groove wall of the drainage groove 24 and part of a groove wall of the first guide groove 23, so that the water in the drainage groove 24 can be discharged through the two outlets 231 at the two ends of each of the first guide grooves 23. When the user rotates to open the louvers 2 to almost reach the vertical state, part of the rainwater trapped in the first guide groove 23 will flow into the drainage groove 24 along the baffle 22 and be constrained by the baffle flange 221, and eventually flow toward two ends of the drainage groove 24 and flow out through the outlets 231, and will not spill inside the canopy when opening the louvers 2.

Figure 9:
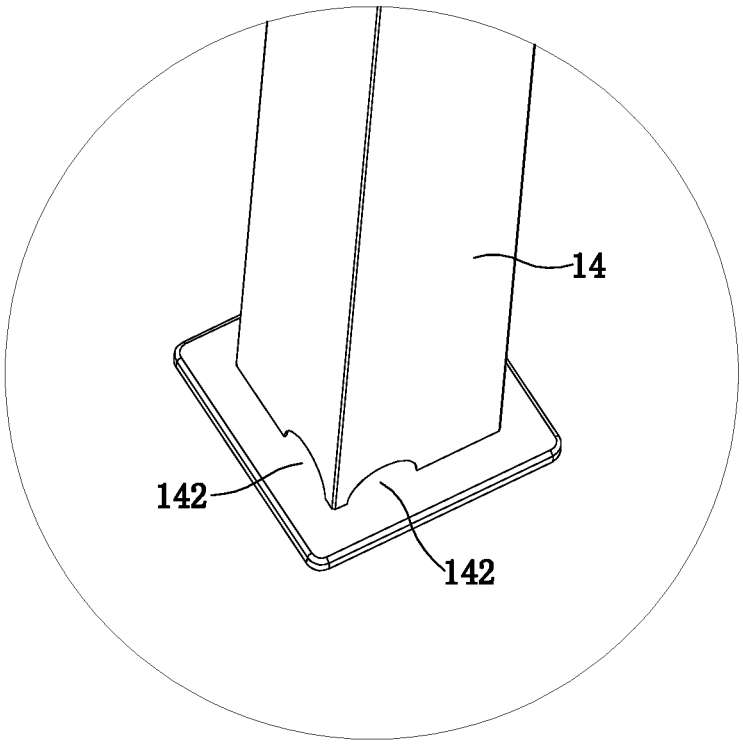
FIG. 9 is an enlarged view of part C in FIG. 7.
Figure 10:
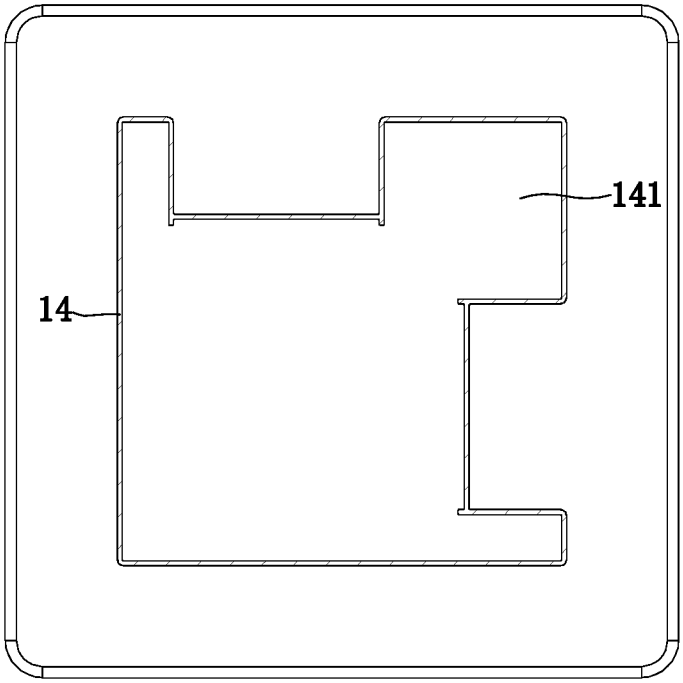
FIG. 10 is a cross-sectional view of one embodiment of a column.

As shown in FIGS. 1-3 and FIG. 7-11, the top of one embodiment of the frame 1 further has a transverse beam 12, and the louvers 2 are arranged on two sides of the transverse beam 12 respectively. By disposing the transverse beam 12 at the top of the frame 1, arranging the louvers 2 on the two sides of the transverse beam 12, and the rafters 11 extending from the transverse beam 12 toward two sides, a slope of the top of the canopy can be greater under a same height condition, which increases the difficulty of accumulation of objects and is beneficial to space utilization. A second guide groove 13 is disposed along a length direction of a corresponding rafter 11 of the rafters 11, and the second guide groove 13 is located directly below junctions of the corresponding rafter 11 and the louvers 2. The transverse beam 12 has a gutter disposing along a length direction of the transverse beam 12, the gutter is located directly below a junction of the louver 2 and the transverse beam 12, and the gutters 15 located on the transverse beam 12 communicate with the second guide grooves 13 located on the rafters 11. In this way, part of the rainwater flowing down from the junctions of the louvers 2 and the rafters 11 can be collected into the second guide grooves 13, and part of the rainwater flowing down from the junctions of the louvers 2 and the transverse beam 12 can be collected into the gutters to prevent the rainwater from affecting the canopy internally.

The frame 1 further includes a plurality of columns 14 supporting the rafters 11, inside each of the columns 14 has a downspout 141 penetrating from top to bottom, and an upper end of each of the downspouts 141 communicates with a lower end of the second guide groove 13 located on each of the rafters 11. By disposing the downspout 141 penetrating from top to bottom inside each of the columns 14 and communicating the upper end of the downspout 141 with the second guide groove 13, rainwater collected in the second guide grooves 13 and the gutters can be discharged along the downspouts 141 inside the columns 14 to further prevent the rainwater from affecting the canopy internally. A bottom of each of the columns 14 is provided with two outfalls 142 facing toward an outer side of the canopy, and the outfalls 142 communicate with a lower end of the downspout 141. By disposing the outfalls 142 facing toward the outer side of the canopy at the bottom of each of the columns 14 to communicate with the downspout 141, the rainwater discharged from the downspouts 141 can flow to the outer side of the canopy through the outfalls 142, such that the canopy will not be affected by the rainwater.

The specific embodiments described herein are merely illustrative of the spirit of the present invention. Technicians skilled in the art to which the present invention pertains can make various modifications or additions to the specific embodiments described or replace them in a similar manner, without departing from the spirit of the present invention or beyond the scope defined by the appended claims.

LIST OF REFERENCED PARTS

1 frame
11 rafter
12 transverse beam
13 second guide groove
14 column
141 downspout
142 outfall
2 louver
21 flashing
21*a* first long side
21*b* second long side
211 flashing flange
212 extended section p 22 baffle
221 baffle flange
23 first guide groove
231 outlet
24 drainage groove
3 activity space

What is claimed is:

1. A louver canopy comprising:

a frame with a top, the top having parallel rafters;

a plurality of louvers, each of the louvers having an elongated flashing, the flashing having a first long side and a second long side; and a baffle disposed at the first long side of the flashing to form an elongated first guide groove, the first guide groove having two outlets respectively disposed at two ends of the first guide groove;

wherein the louvers are rotationally connected between the rafters and sequentially arranged along a length direction of the rafters, and the louvers are disposed at intervals and are parallel to each other;

wherein when the louvers rotate to a closed state, an opening of the first guide groove faces upward, and the second long side of the flashing passes over a top of the baffle of an adjacent louver of the louvers and positions above the first guide groove of the adjacent louver; and wherein each of the rafters has a second guide groove disposed along a length direction of each of the rafters, the second guide groove is located directly below junctions of the louvers and a corresponding rafter of the rafters, the outlets at the two ends of the first guide groove respectively communicate with the second guide groove, the frame further includes a plurality of columns supporting the rafters, inside each of the columns is a downspout penetrating from a top of each of the columns to a bottom of each of the columns, an upper end of the downspout of each of the columns communicates with the second guide groove, a bottom of each of the columns is provided with outfalls facing toward an outer side of the canopy, and the outfalls communicate with a lower end of the downspout of each of the columns.

2. The louver canopy as claimed in claim 1, wherein each of the rafters is disposed obliquely, the flashing has an extended section extending toward the first guide groove of the adjacent louver; and wherein when the louvers rotate to the closed state, a trough wall of the first guide groove located at a side of the baffle is higher than the flashing.

3. The louver canopy as claimed in claim 1, wherein when the louvers rotate to the closed state, an activity space is formed between the second long side of the flashing and the baffle of the adjacent louver, and continued rotation of the louvers is capable of causing the baffle and the adjacent louver to abut each other.

4. The louver canopy as claimed in claim 1, wherein the second long side of the flashing is bent and extended to form a flashing flange, and when the louvers rotate to the closed state, the flashing flange is inserted into the first guide groove of the adjacent louver.

5. The louver canopy as claimed in claim 1, wherein a baffle flange bending toward the flashing is provided to an edge of the baffle away from the flashing, and a drainage groove is formed.

6. The louver canopy as claimed in claim 1, wherein a width dimension of the opening of the first guide groove is greater than ¼ of a width dimension of the flashing.

7. The louver canopy as claimed in claim 1, wherein the top of the frame further has a transverse beam, and the louvers are arranged on two sides of the transverse beam.

8. The louver canopy as claimed in claim 7, wherein the transverse beam has gutters along a length direction of the transverse beam, the gutters are located directly below a junction of the louver and the transverse beam, and two ends of each of the gutters communicate with the second guide groove respectively.

* * * * *